United States Patent [19]

Heyden et al.

[11] 4,130,039

[45] Dec. 19, 1978

[54] CUTTING DEVICE

[75] Inventors: Günter Heyden; Günter Geitz, both of Neuwied, Fed. Rep. of Germany

[73] Assignee: Winkler & Dunnebier Maschinenfabrik und Eisengiesserei GmbH & Co., KG, Neuwied am Rhein, Fed. Rep. of Germany

[21] Appl. No.: 807,844

[22] Filed: Jun. 20, 1977

[30] Foreign Application Priority Data

Jun. 25, 1976 [DE] Fed. Rep. of Germany ..... 2628728

[51] Int. Cl.[2] ..... B26D 5/20

[52] U.S. Cl. ..... 83/356.3; 83/342; 83/911; 83/355

[58] Field of Search ..... 83/355, 342, 356.3, 83/911, 699

[56] References Cited

U.S. PATENT DOCUMENTS

| | | | |
|---|---|---|---|
| 864,552 | 8/1907 | Perkins et al. | 83/356.3 |
| 2,100,930 | 11/1937 | Hiken | 83/342 |
| 3,327,576 | 6/1967 | Heywood | 83/355 |
| 3,367,222 | 2/1968 | Mummery | 83/355 |
| 3,782,233 | 1/1974 | Helm | 83/911 |
| 4,016,789 | 4/1977 | Helm | 83/355 |

*Primary Examiner*—Donald R. Schram

*Attorney, Agent, or Firm*—Allison C. Collard; Thomas M. Galgano

[57] ABSTRACT

An improved cutting device of the type having rotary vane knives, which cooperate with stationary knives, for making patterned cuts in the edges of paper webs, particularly for the preparation of envelopes or envelope blanks, is provided. The device includes at least one cooperating knife pair, comprising one rotary knife and one stationary knife, disposed for cooperative engagement for making patterned cuts in the edges of paper webs moving therepast. The blades are made of materials differing from one another in hardness to an extent such that the softer knife can have material removed from it without damage to the latter, and at least one of the knives of the cooperating knife pair, is mounted for feeding movement toward its associated cooperating knife, while the cutting device is operated.

3 Claims, 3 Drawing Figures

Fig. 2
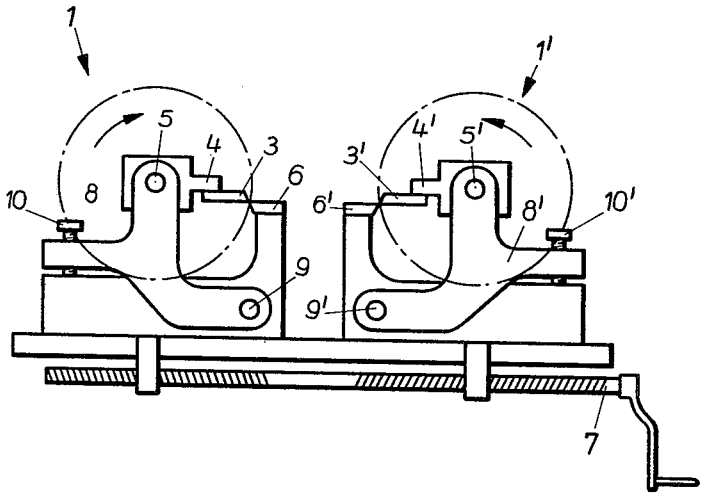
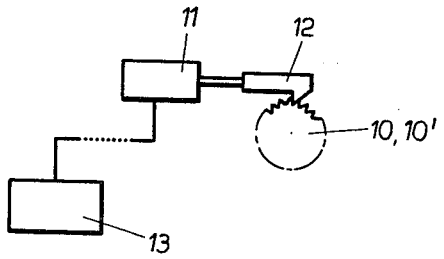
Fig. 3

CUTTING DEVICE

The invention relates to a cutting device comprising rotating vane knives which cooperate with stationary knives or blades, for making patterned cuts in the edges of moving webs of material. More particularly, it relates to such a cutting device for making patterned cuts in the edges of paper webs for the preparation of envelopes or envelope blanks.

Devices of this kind are known as a component of roller punches or roller-type envelope machines. For instance, German Utility Model 1,769,668 describes vane knives cooperating with stationary blades or knives, the cutting edges of the blades or knives being inclined to have a slight setback, so as to produce a shear cut. The vane knives thus devised were found to have excellent cutting properties, and so the proposed edge geometry and the arrangement of the blades or knives have remained satisfactory to the present day. However, as a result of the abrupt increase in machine speeds, made possibly by trends in technical development of envelope machines, the materials originally used for the cutting edges, such as copper on steel or soft steel, for the top and bottom blades or knives, ceased to provide a satisfactory edge life for knives or blades subjected to modern requirements. Consequently, as envelope machines developed, the ledge life of the blades or knives was lengthened by using harder cutting materials. Meanwhile, development has led to the use of very hard steels or alloys, giving edge lives of up to several million cuts.

Unfortunately, vane knives designed for long edge lives, have considerable disadvantages. Not only do they have to be made of expensive material, but also, they are difficult to machine. The bottom blades can be shaped at reasonable expense by erosion tools, but in the case of the top blades or knives, machining is possible only up to some extent because they are positioned at an inclination to the bottom blades. Accurate adaptation thereto is a job requiring tedious and time-consuming manual work, with the use of special gauges. Problems also arise in the fitting of the blades or knives. To ensure reliable cutting, the gap between the top blade and bottom blade, must be only a very small proportion of the thickness of the paper to be cut; on the other hand, if the two blades strike one another, both cutting edges are destroyed. The blades must therefore be arranged very carefully, and their arrangement is something which can be done only by skilled operators and with considerable consumption of time. A change of format or a repair to a blade is therefore an expensive matter, causing long machine down times.

It is therefore an object of the invention to provide a vane-type cutting device, having a long edge life and free from the disadvantages associated with the use of hard-cutting materials. According to the invention, therefore, the cooperating knives or blades, or the like, are made of materials differing from one another in hardness to an extent such that the softer blade or knife can have material removed from it by the harder blade or knife, without damage to the latter, and at least one of the knives of the cooperating knife or blade pairs is so mounted as to be adapted to be fed towards it associated blade or knife, while the cutting device is operating.

Basically, it is immaterial whether the rotating top blade or knife, or the stationary bottom blade or knife is made of a readily machinable material. However, since, as previously stated, it is simpler for reasons of production engineering to produce the stationary bottom blade to an accurate shape, it is advantageous to use hard material for the bottom blade, and to use the readily machinable material for the rotating top blade or knife.

An advantage of the invention is that the stringent requirements — which can be met only be subsequent manual work — as regards the accuracy of shape of the rotating top blades in their manufacture disappear, and that since the top blades or knives can be adapted to the shape of the bottom blades or knives by removal of material, no tedious adjusting work and therefore no expensive machine down times are associated with the setting-up and arranging of the blades or knives. Instead, the top blades or knives now merely have to be coarse-shaped in manufacture, receiving their final and dead-accurate shape in the actual cutting machine, as a result of being infed gradually onto the bottom blade in a few revolutions, this shaping process also covering alignment or arrangement of the blades.

Another advantage is the very high edge life of such blades or knives. When cutting ability decreases, i.e., when the wear of the top blade cutting edge has exceeded a permissible value, the blades can be sharpened automatically just by being infed towards one another, and without stopping the machine. Consequently, the edge life of such blades or knives can be considered to be not the number of cuts between such sharpenings, but the number of cuts over the entire utilizable infeed distance. Tests on ordinary paper qualities in which the bottom blades were made of hardened steel and the top blades were made of a wrought aluminum alloy for the top blades, resulted in edge lives of at least 200,000 cuts between infeed operations, an infeed of 15 $\mu$m maximum, sufficing to restore full cutting ability. Consequently, a total infeed distance of approximately 15 mm, a value which is readily obtainable so far as construction is concerned, gives a working life and, therefore, an edge life of the blades of $200{,}000 \cdot (15/0.015) = 200 \cdot 10^6$ cuts. Transferring figures to a production machine, this means that, depending upon the speed of the machine, the machine operators need to adjust the vane-cutting station only once or twice a shift, and the adjustment itself requires little manual intervention and, therefore, takes up a negligible amount of time.

In a development of the invention, an automatic infeed facility controlled, e.g., in dependence upon the number of cuts, can be disposed on the cutting device. The long blade edge life previously mentioned, can then be achieved without any intervention by the machine operators.

Other objects and features of the present invention will become apparent from the following detailed description, considered in connection with the accompanying drawing, which discloses a single embodiment of the invention. It is to be understood, however, that the drawing is designed for the purpose of illustration only, and not as a definition of the limits of the invention.

In the drawing, wherein similar reference characters denote similar elements through the several views:

FIG. 2 is a front view of the device shown in FIG. 1; and

FIG. 3 shows a facility for automatic infeeding of the blades or knives.

Figure 1:
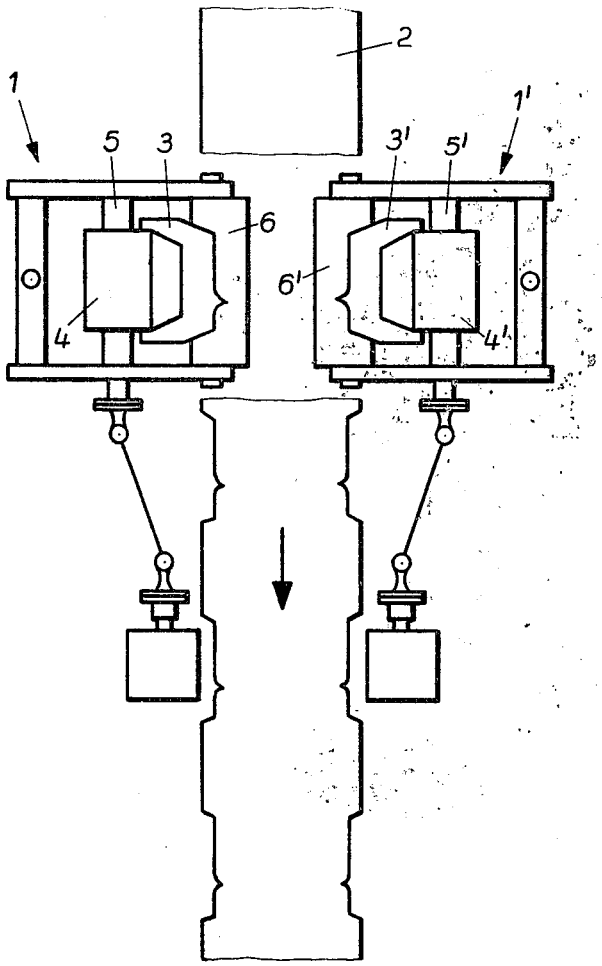
FIG. 1 is a plan view of a vane knife or blade-type cutting device, embodying the present invention.

Referring now to FIGS. 1 and 2, therein illustrated is a vane knife-type cutting device, comprising in conventional manner, two component or partial devices 1,1', so placed on both sides of a web 2 of material, to be treated as to act thereon together. Rotating vane knives 3,3' are secured by way of carriers or supports 4,4' to rotating shafts 5,5', running in directions indicated by arrows. There can be seen associated, stationary knives or blades 6,6', respectively. The separation between the component devices 1 and 1' can be adjusted for adaptation to different widths of webs 2. Adjustment of the separation is made by a screw-threaded spindle 7.

In contrast to the conventional device in which both the cooperating blades are made of a hardened material, in the present instance, only the bottom blades 6,6' are made of hardened steel, but the rotating top blades or knives 3,3' are made of a material which can be removed readily on the bottom blades; wrought aluminum alloys are preferred, since they combine two properties, ready machinability and adequate strength, which are advantageous for the purposes of this invention. For alignment and sharpening the top blades 3,3' have to be infed to the bottom blades 6,6', respectively, in the manner described, with the device operating. Accordingly, frames 8,8' receiving shafts 5,5', respectively, and therefore top blades or knives 3,3' respectively, are mounted for pivoting around a respective pivot 9,9'. Disposed at the opposite side of frames 8,8' are screws 10,10', providing a fine control for pivoting frames 8,8' around their pivots 9,9' by small amounts. Pivots 9,9' are such that pivoting of the frames alters the distance between bottom blades 6,6', on the one hand, and shafts 5,5', on the other hand, but leaves virtually unaltered the angular position of top blades 3,3' at the instant when they act on the paper web.

The embodiment of the invention described can readily be amplified to include automatic infeeding. All that is necessary is to provide a facility, which acts at predetermined intervals of time on screws 10,10'. A convenient way of achieving this is shown in diagrammatic form in FIG. 3. The heads of adjusting screws 10,10' are devised as ratchet wheels, each engaged by a pawl operated by an electromagnet 11. This arrangement acts like a stepping mechanism. The number of teeth of the ratchet wheel, the pitch of screws 10,10' and the lever relationships to frames 8,8' are so adapted to one another that each operative movement of electromagnet 11 produces an approximately 15 $\mu$m infeeding movement of top blades or knives 3,3' towards bottom blades or knives 6,6', respectively. The electromagnet 11 is under the control of a counter 13, which counts the number of revolutions of the machine. Once the count of counter 13 goes beyond a predeterminable selected figure, e.g., 200,000 revolutions, counter 13 outputs a control or actuating signal.

In addition to the embodiment which has been described in detail, other embodiments are possible, which differ mainly as regards infeeding. For instance, frames 8,8' can be mounted in guides, so that the infeeding movement of top blades or knives 3,3' is rectilinear. Another possibility is to vary the radius of rotation of top blades or knives 3,3'. In this case, top blades 3,3' are adapted to move radially, relative to holders 4,4', and are moved relatively thereto by some form of actuator, e.g., a movable wedge, which extends coaxially through shafts 5,5'.

While several embodiments of the present invention have been shown and described, it will be obvious to those persons of ordinary skill in the art, that many changes and modifications may be made thereunto, without departing from the spirit and scope of the invention.

What is claimed is:

1. In a cutting device of the type having rotary vane knives which cooperate with stationary knives, for making patterned cuts in the longitudinal edges of a paper web fed therepast, for the preparation of envelopes or envelope blanks, the improvement comprising:

at least one cooperating knife pair, including one rotary knife made of an aluminium alloy and one stationary knife made of hardened steel, disposed for cooperative engagement, for making patterned cuts in the edges of paper webs moving therepast, said blades being made of materials differing from one another in hardness to an extent such that the softer knife can have material removed from it without damage to the latter, and at least one of the knives of said cooperating knife pair being mounted for feeding movement toward its associated cooperating knife, while the cutting device is operated, said knife which makes the infeeding movement, being mounted on a frame pivotable around a pivot, which pivot is positioned such that, irrespective of its infeed, the rotary knife, when in the cutting position, always takes up the same angular position relative to the paper web fed therepast.

2. The device according to claim 1 additionally including means for initiating the infeeding movement automatically.

3. The device according to claim 2, characterized in that a counter-controlled mechanism is provided, which makes an infeeding movement after a predetermined number of cuts.

* * * * *